US006742809B2

(12) United States Patent
Frosig et al.

(10) Patent No.: US 6,742,809 B2
(45) Date of Patent: Jun. 1, 2004

(54) PHOTO ALBUM CONSTRUCTED FROM A STRIP OF IMAGES

(75) Inventors: Peter A. Frosig, Rochester, NY (US); Joseph A. Manico, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 2 days.

(21) Appl. No.: 10/047,875

(22) Filed: Oct. 22, 2001

(65) Prior Publication Data

US 2003/0075917 A1 Apr. 24, 2003

(51) Int. Cl.[7] ..... B42D 1/00

(52) U.S. Cl. ..... 281/21.1; 40/700; 281/3.1; 281/15.1; 281/29; 281/38; 283/61; D19/26; D19/33

(58) Field of Search ..... 281/2, 3.1, 5, 15.1, 281/21.1, 23, 29, 38, 36, 37; 283/61, 62, 34; D19/26, 33; 40/700, 705, 707, 725, 726

(56) References Cited

U.S. PATENT DOCUMENTS 3,738,686 A * 6/1973 Morse ..... 283/63.1
3,869,820 A 3/1975 Holson
4,524,993 A 6/1985 Walker-Taylor
4,538,833 A * 9/1985 Trikilis ..... 281/2
4,586,729 A 5/1986 Beylerian
4,685,699 A 8/1987 Hirasawa
4,830,404 A 5/1989 Lu
4,900,001 A 2/1990 Lapeyre
D311,219 S 10/1990 Bergh
5,033,964 A 7/1991 Phelps
5,398,289 A * 3/1995 Rourke et al. ..... 382/100
5,403,138 A 4/1995 Otake et al.
5,562,309 A * 10/1996 Brink et al. ..... 281/15.1
D390,871 S 2/1998 Whitney
5,791,692 A 8/1998 Manico et al.
5,957,502 A 9/1999 Manico et al.
6,000,722 A * 12/1999 Werner et al. ..... 281/29
6,004,061 A 12/1999 Manico et al.
6,324,545 B1 * 11/2001 Morag ..... 707/202
6,431,606 B1 * 8/2002 Lowe et al. ..... 281/38

* cited by examiner

*Primary Examiner*—Monica S. Carter
(74) *Attorney, Agent, or Firm*—Frank Pincelli

(57) ABSTRACT

A photo album is disclosed, made from a unitary strip of image bearing media having images printed in a predetermined sequence. A plurality of pages is formed by folding the image media strip between the images into accordion folds and adhering the folds together so that each pair of the images forms two sides of a page. The photo album may have reinforced front and rear photo album covers. A binding holds the pages together.

18 Claims, 7 Drawing Sheets

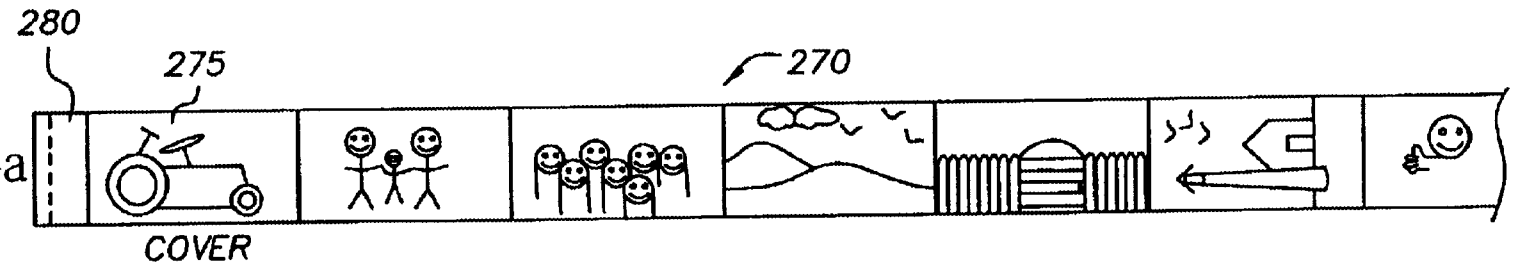
FIG. 4a
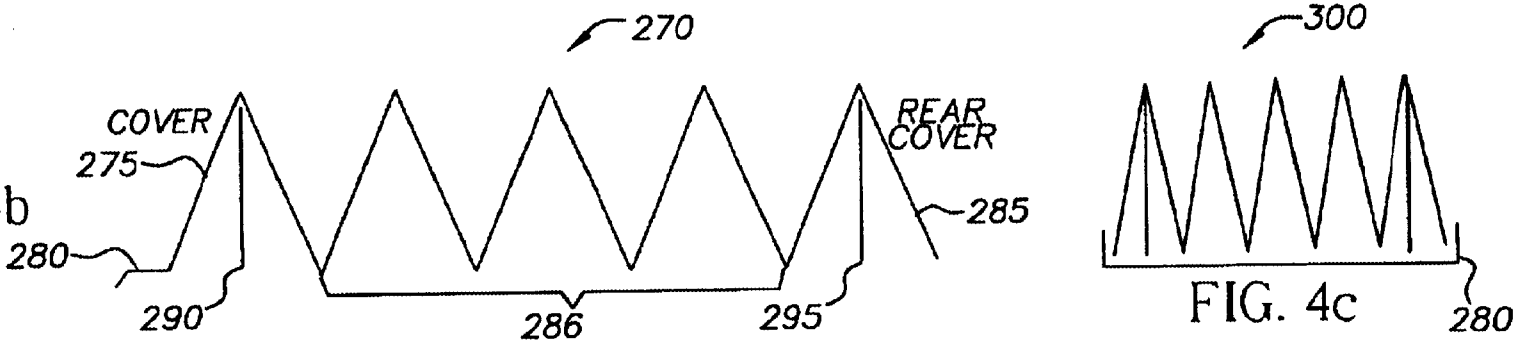
FIG. 4b
FIG. 4c

PHOTO ALBUM CONSTRUCTED FROM A STRIP OF IMAGES

FIELD OF THE INVENTION

This invention is in the field of photo albums and methods of making photo albums and, more particularly, it is in the field of photo albums made by folding a strip of images.

BACKGROUND OF THE INVENTION

Much photofinishing and printing/reproduction equipment is manufactured to print onto roll-form strips of image bearing media. This aids in productivity and allows orders to be addressed sequentially. Photofinishing orders are typically returned to customers as stacks of 4×6 inch prints or of some other convenient size which have been cut from the roll-form strips after printing. Often customers will then assemble their prints into photo albums using any of a large number of available photo albums designed to accept individual prints. More recently, the concept of providing pictures to customers in the form of pre-printed album pages has been introduced into the marketplace. The advent of digital printing technology has enabled the printing of multiple images on the same page and the sizes of the images selected for printing and layout of the images on a page can be varied almost infinitely for this type of product in accord with the customers needs. A particularly useful form of such an album page is the Kodak Picture Page©, offered by the Eastman Kodak Company, which is produced by first printing images on large size (up to 10 to 14 inches or larger) image bearing media and then folding the media over and adhering it to itself to create a two-sided album leaf page with stiffness and feel appropriate to a high quality photo album. As mentioned, the album pages produced in this way utilize paper larger than the typical roll-form strip and are produced "off-line" in separate cutting, folding and sealing operations. Methods of producing such two-sided album pages are disclosed in the series of U.S. Pat. Nos. 5,791,692; 5,957,502; and 6,004,061 along with commonly assigned co-pending U.S. patent application Ser. Nos. 09/452,336 and 09/450,608 to Manico. There remains a need, however, for a convenient means for producing a complete photo album having multiple two-sided folded pages of the type described above and preferably having reinforced front and rear covers, but which utilizes directly the roll-form strips of media which are ordinarily available in a photofinishing operation.

A book assembly, possibly adaptable to the needs of such a photo album, made by accordion-folding a paper strip of printed pages has been disclosed in U.S. Pat. No. 4,524,993. However, the '993 patent does not teach the adhering of the accordion folds together to form pages of feel and stiffness appropriate to a photo album. Accordion folded pages which are not adhered together as shown in the '993 patent are inherently more difficult to bind by the conventional means normally employed for binding books where pages are secured at the base by adhesive. Further, the '993 patent does not teach a means for creating reinforced front and rear covers for the book.

SUMMARY OF THE INVENTION

In answer to the needs identified above, there is provided in accordance with one aspect of the present invention a photo album made from a unitary strip of image bearing media having a plurality of images printed in a pre-determined sequence thereon the plurality of images forming adjacent pairs of images, comprising a plurality of integral pages formed by folding the image media strip between the images into accordion folds so that each of the pairs of adjacent images forms two sides of a page, the accordion folds being adhered together on the inside and a binding holding the pages together, the binding comprising a flap formed integrally at the end of the media strip, the flap being folded around the base of the pages and adhered to the pages.

In accordance with another aspect of the present invention, there is also provided a seamless photo album made from a unitary strip of image bearing media having a plurality of images printed in a pre-determined sequence thereon, the plurality of images forming adjacent pairs of images comprising a plurality of integral pages formed by folding the image media strip between the images into accordion folds so that each pair of the adjacent pairs of images forms two sides of a page, the accordion folds being adhered together on the inside, a rear album cover formed from the last accordion fold, a binding for the photo album formed by wrapping the media strip around and adhering to the base of the plurality of pages and a front album cover formed by folding an end of the image media strip over and tucking the end into the photo album and securing.

In accordance with still another aspect of the present invention, there is provided a seamless photo album made from a unitary strip of image bearing media having a plurality images printed in a pre-determined sequence thereon, the plurality of images forming adjacent pairs of images comprising a plurality of integral pages formed by folding the image media strip between the pairs of images into accordion folds so that each pair of the images forms two sides of a page, the accordion folds being adhered together on the inside, a rear album cover formed from the last accordion fold, a front album cover formed by wrapping an end of the media strip around the base of the pages, folding the end of the image media strip over and inserting the end into the photo album and a binding for the photo album formed by adhering the end of the media strip to the base of the plurality of pages.

In accordance with yet another aspect of the present invention, there is provided a method of making a photo album, comprising the steps of obtaining a plurality of images, specifying a desired order of appearance of the images in the photo album, the first image being designated to appear on the photo album's front cover and the last image being designated to appear on the photo album's rear cover, printing the plurality of images in the specified order sequentially on the image bearing side of a roll of imaging media, the plurality of images forming adjacent pairs of sequential images, separating the printed images from the roll in a continuous strip of media, folding the media strip between the sequential images into accordion folds so that each of the pairs of sequential images forms two sides of a page of the photo album, first and last the accordion folds forming the front and the rear covers of the photo album respectively, adhering the pair of images forming each the page together on the inside of the accordion folds, reinforcing the front and rear photo album with stiffening sheets and binding the pages together.

In accordance with still another aspect of the present invention, there is provided a photo album made from a unitary strip of image bearing media having a plurality of images printed in a pre-determined sequence thereon. The plurality of images forming adjacent pairs of images, comprising a plurality of integral pages formed by folding the image media strip between the images into accordion folds so that each of the pairs of adjacent images forms two sides of a page. The accordion folds being adhered together on the inside and reinforced front and rear album covers formed by folding end sections of the image media strip inside first and last of the accordion folds respectively and adhering the end sections to the accordion folds.

In yet another aspect of the present invention there is provided a method of making a photo album, comprising the steps of obtaining a plurality of images, specifying a desired order of appearance of the images in the photo album. The first image being designated to appear on the photo album's front cover and the last image being designated to appear on the photo album's rear cover printing the plurality of images in the specified order sequentially on the image bearing side of a roll of imaging media. The plurality of images forming adjacent pairs of sequential images, separating the printed images from the roll in a continuous strip of media folding the media strip between the sequential images into accordion folds so that each of the pair of sequential images form two sides of a page of the photo album. First and last, the accordion folds forming the front and the rear covers of the photo album respectively adhering the pair of images forming each page together on the inside of the accordion folds reinforcing the front and rear photo album with stiffening sheets, securing the pages with a binding clip and binding the pages together.

In accordance with still another aspect of the present invention, there is provided a method of making a photo album, comprising the steps of obtaining a plurality of images specifying a desired order of appearance of the images in the photo album. The first image being designated to appear on the photo album's front cover and the last image being designated to appear on the photo album's rear cover printing the plurality of images in the specified order sequentially on the image bearing side of a roll of imaging media. The plurality of images forming adjacent pairs of sequential images separating the printed images from the roll in a continuous strip of media folding the media strip between the sequential images into accordion folds so that each of the pair of sequential images forms two sides of a page of the photo album, first and last the accordion folds forming the front and the rear covers of the photo album respectively adhering the pair of images forming each the page together on the inside of the accordion folds reinforcing the front and rear photo album with stiffening sheets folding a flap of media around the base of the pages and adhering the end to the pages, the flap being formed integrally at an end of the media strip and binding the pages together. These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which:

FIGS. 4*a*–4*c* illustrate steps in the formation of an alternative embodiment of a photo album made in accordance with the present invention;

DETAILED DESCRIPTION OF THE INVENTION

Figure 1A:
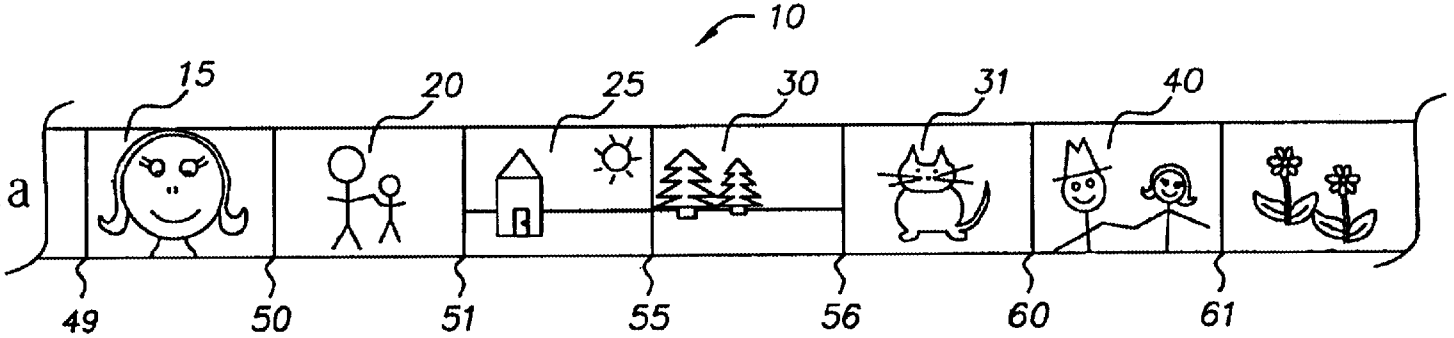
FIG. 1*a* illustrates a strip of image bearing media with prints printed thereon in accordance with the present invention.
Figure 1B:
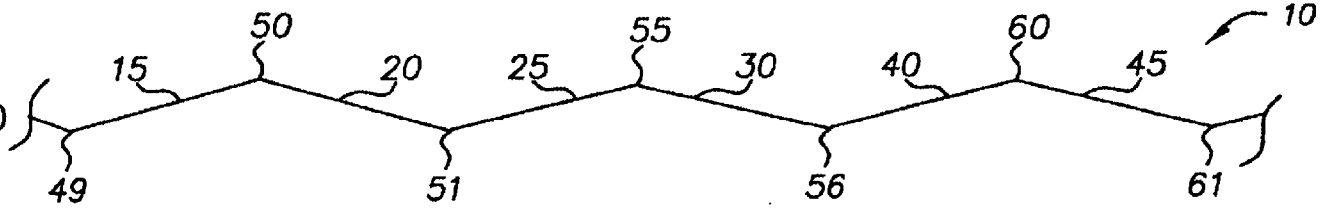
FIG. 1*b* shows an edge view of the media strip of FIG. 1*a* into which accordion folds have been introduced in accordance with the present invention.
Figure 1C:
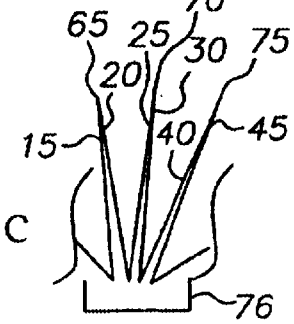
FIG. 1*c* also shows an edge view of the strip of FIG. 1*a* where album pages have been formed in accordance with the present invention.

Turning first to FIGS. 1*a*–1*c*, there is illustrated the basic method of formation of the pages of a photo album from a unitary strip of images. Preferably, the unitary strip of images is made from a single strip of media, however, the unitary strip may be made from two or more strips that are permanently secured together to form a unitary continues strip of media. This basic method is used in the construction of all embodiments of photo albums disclosed herein made in accordance with the present invention. FIG. 1*a* illustrates a portion of a strip of image bearing media 10 with images (15, 20, 25, 30, 35, 40) printed face up on the strip 10. Positions 49, 50, 51, 55, 56, 60 and 61 correspond to the point at which the images 15 and 20, 25 and 30 and 35 and 40, respectively, abut. The printing of such images on a roll of image bearing media to produce a strip such as that illustrated in FIG. 1*a* may be carried out using either an optical or digital photographic roll printer, such as that found in a typical wholesale or retail photofinishing operation. Other digital or optical printing methods which are able to utilize a roll of image bearing media such as electrophotographic printing, ink jet printing or thermal dye transfer printing may also be used to produce the strip 10 of FIG. 1*a*. In FIG. 1*b*, which depicts an edge view of strip 10, accordion folds have been introduced into strip 10 at abutting positions 49, 50, 51, 55, 56, 60 and 61. The introduction of accordion folds could be a manual operation or could be carried out with the assistance of simple paper folding apparatus. The paper folding art is old and equipment for carrying out creasing and fan or accordion folding operations is readily available. Finally, FIG. 1*c* illustrates the completed accordion folding of the strip 10 where the accordion folds have been adhered together to form pages 65, 70 and 75, each pair of images (15-20, 25-30 and 35-40) now forming opposing sides of pages 65, 70 and 75 respectively. Since the pages are folded back onto one another to form pages, a paper stock thinner than that of the usual photo print paper may be used to avoid undue bulk in the resulting photo album. A good method of adhering the accordion folds together to form pages is disclosed in U.S. Pat. No. 5,791,692 to Manico, where a dry mount tissue sheet or another type of adhesive sheet such as a pressure sensitive adhesive appropriately sized to fit inside the fold is inserted in the fold and the folded page then sealed with the aid of a heat press or laminator. It will be appreciated that a simple binding clip 76, either cemented in place or held in place by friction, may be added at this stage to bind the completed pages together to form a simple album. Further steps in photo album creation, including the formation of reinforced album covers will be described later.

The order in which the images are printed on the image bearing media strip 10 may reflect the sequence of a customer's original film processing order so that the resulting pages will simply display the images from start to finish as they appeared on the customer's roll of film. It will be appreciated, however, that the images could also be printed in any order desired by the customer. If optically printed, negatives could be supplied by the customer in a specified sequence and the order could be printed as if for a reprint order. If the printing is carried out by digital means, for example using a Kodak Model 27 DLS digital minilab printer or like equipment, then essentially any digital images stored as digital files and in any order, may be specified by the customer. Digital files could, for example, be supplied by the customer stored on a removable memory card from a digital camera or some other storage medium such as Kodak Picture Disk©, Kodak Picture CD© or other removable memory device. Digital images could also be supplied by a customer by uploading over a communications network from a home computer or kiosk to his or her online account at a photo fulfillment website such as Kodak PhotoNet Online© for fulfillment of the photo album order.

If the images are printed digitally, additional non-image data, such as text or titles may be conveniently added to the layout. For example, an entire page of the photo album could be made up of text or text could simply be added as an overlay to an image or composited with an image to create a title for the image or other annotation related to the image. Information for titles or annotations could be obtained automatically from encoded information recorded by the camera at the time the image was captured, such as the date and time or geographic location of image capture. Alternatively, additional information for titles and annotations can be supplied by the customer when the photo album order is specified. If digital printing technology is used, pages could be printed where images have been composited with various graphics such as borders or backgrounds if this is desired by the customer.

If it is also possible to include a panoramic image in a photo album made in accordance with the present invention. Panoramic images may be captured using a one-time-use camera such as the Kodak MAX Panoramic One-Time-Use Camera© or an Advanced Photo System (APS) camera, such as the Kodak Advantix© line of cameras or any camera having APS features. Alternatively, a digital image file captured originally by a digital camera may be cropped and reformatted electronically to the aspect ratio of a panoramic image. Since such a panoramic image when printed typically has a width to height ratio approximately twice the width of a standard size photographic print, it is possible to print a panoramic image so that it occupies two adjacent pages in a photo album. Referring to FIGS. 1*a*–1*c* again, if images 20 and 25 represent such a double-width panoramic image, then it will be seen, as shown in FIG. 1*c*, that when the accordion folds have been completed, the panoramic image will be folded in the center at position 51 and will extend over the inside of pages 65 and 70. Images 20 and 25 will be able to be viewed together as a panoramic image when the pages are opened so that the insides of pages 65 and 70 are visible to a person viewing them.

Figure 2A:
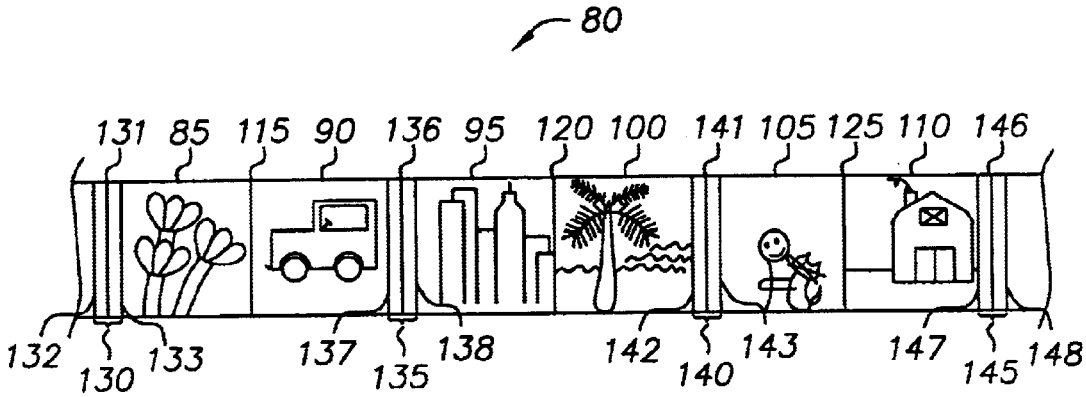
FIGS. 2*a*–2*c* illustrate steps in the formation of an alternative embodiment of photo album pages made in accordance with the present invention.
Figure 2B:
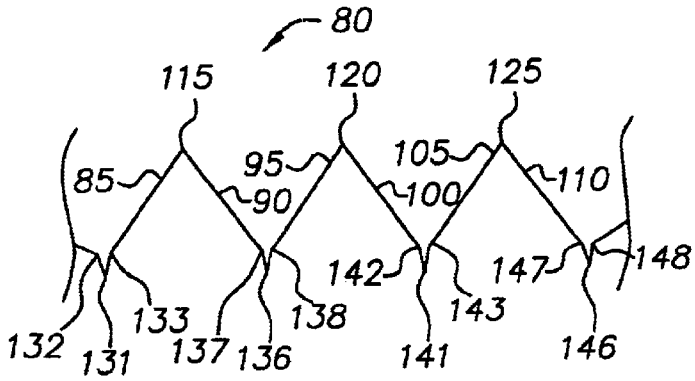
Figure 2C:
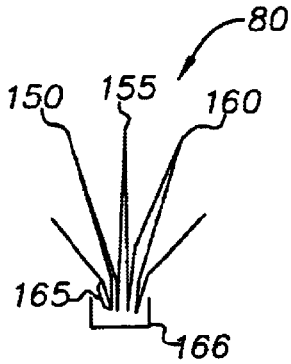

When printing images for a photo album made in accordance with the present invention, it may also be desirable to leave a non-image area between pairs of images on the strip to provide a gutter margin (the gutter margin in a book for the present invention is the inner margin area of a page adjoining the spine of a book) to prevent the binding of the pages of the photo album from intruding into and obscuring the image area of the pages. FIGS. 2*a*–2*c* illustrate this aspect of the invention. FIG. 2*a* depicts a portion of a strip of image bearing media 80 with images (85, 90, 95, 100, 105, 110) printed face up on the strip 80. Positions 115, 120 and 125 are the points at which image pairs 85 and 90, 95 and 100 and 105 and 110, respectively, abut. Also shown in FIG. 2*a* are gutter margin areas 130, 135, 140 and 145 formed by advancing the roll of image bearing media in the printer a pre-determined amount between the printing of images and defined by fold line positions 132, 133, 137, 138, 142, 143, 147 and 148. Positions 131, 136, 141 and 146 are the center points of gutter margin areas 130, 135, 140 and 145 respectively. In FIG. 2*b* is shown an edge view of strip 80 wherein accordion folds have been introduced at positions 115, 131, 120, 125, 136, 141 and 146 respectively. FIG. 2*c* illustrates the completed accordion folding of the strip 80 where the accordion folds have been adhered together to form pages 150, 155 and 160. The gutter margin area 165 for use in binding has been formed utilizing non-image areas 130, 135, 140 and 145 and introducing folds at positions 132, 133, 137, 138, 142, 143, 147 and 148. Methods useful for folding and adhering the folds together are identical to those described earlier for the embodiment of FIG. 1. As described earlier for the album pages of FIG. 1, a binding clip 166, either cemented in place or held in place by friction, may be added at this stage to bind the completed pages together to form a simple album.

Figure 3A:
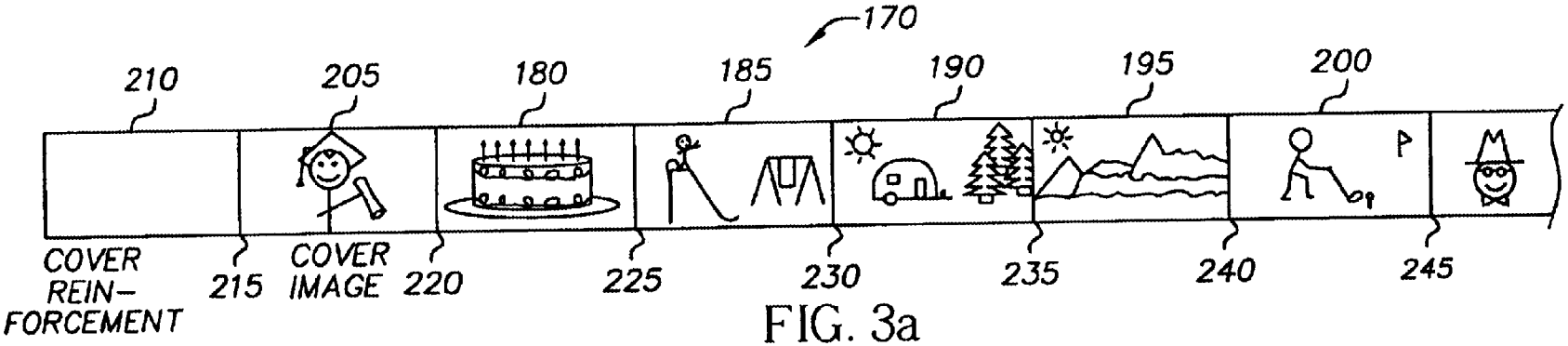
FIGS. 3*a*–3*c* illustrate steps in the formation of a photo album with reinforced covers made in accordance with the present invention.
Figure 3C:
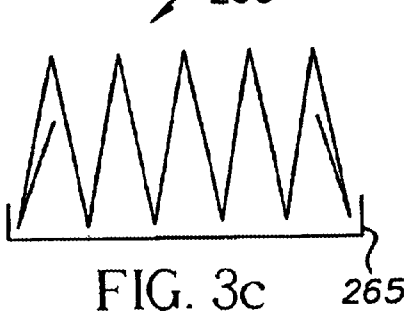
Figure 3B:
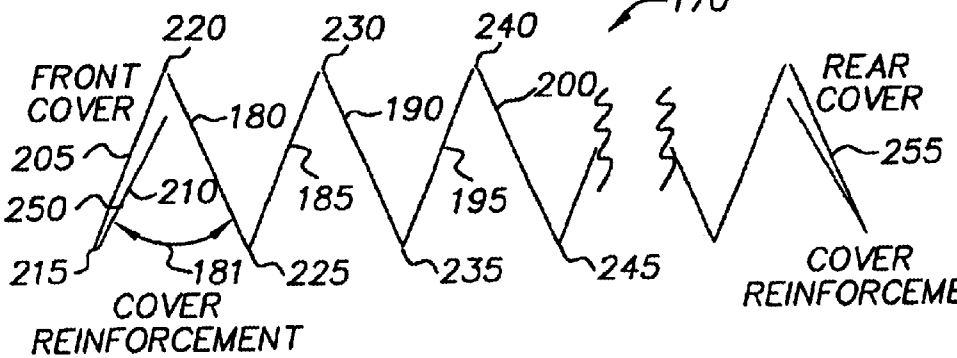

Having illustrated the basic method of forming photo album pages from a unitary strip of printed images, we now proceed to describe the formation of reinforced photo album covers, also from the same strip of images used to form the pages of the photo album. Turning to FIG. 3*a*, a strip of image bearing media 170 is shown with images 180, 185, 190, 195 and 200 printed face up on strip 170. Also shown are photo album front cover image 205 and cover reinforcement end section 210. Positions 215, 220, 225, 230, 235, 240 and 245 are the points at which the image segments on the strip abut, as previously illustrated in FIGS. 1 and 2. Cover image 205 may be a photograph or may comprise text corresponding, for example, to the title of the photo album or a combination of text with a photograph. Not shown in FIG. 3*a* is a corresponding rear cover image for the photo album and its corresponding reinforcement end section. FIG. 3*b* illustrates the strip 170 with accordion folds introduced at positions 220, 225, 230, 235, 240 and 245 to form photo album pages in a manner exactly analogous to that shown previously in FIGS. 1 and 2. The reinforced front cover 250 for the photo album is formed by first folding (at position 215) reinforcement end section 210 against the back side of cover image 205, then adhering end section 210 to both the back side of cover image 205 and to the back side of image 180 as indicated by arrow 181. A corresponding reinforced rear cover 255 for the photo album is formed in a similar manner. FIG. 3*c* shows a slightly exploded view of the completed photo album 260. Friction binding clip 265 has been added to bind the photo album together. Alternatively, binding clip 265 may be cemented in place.

Figure 4D:
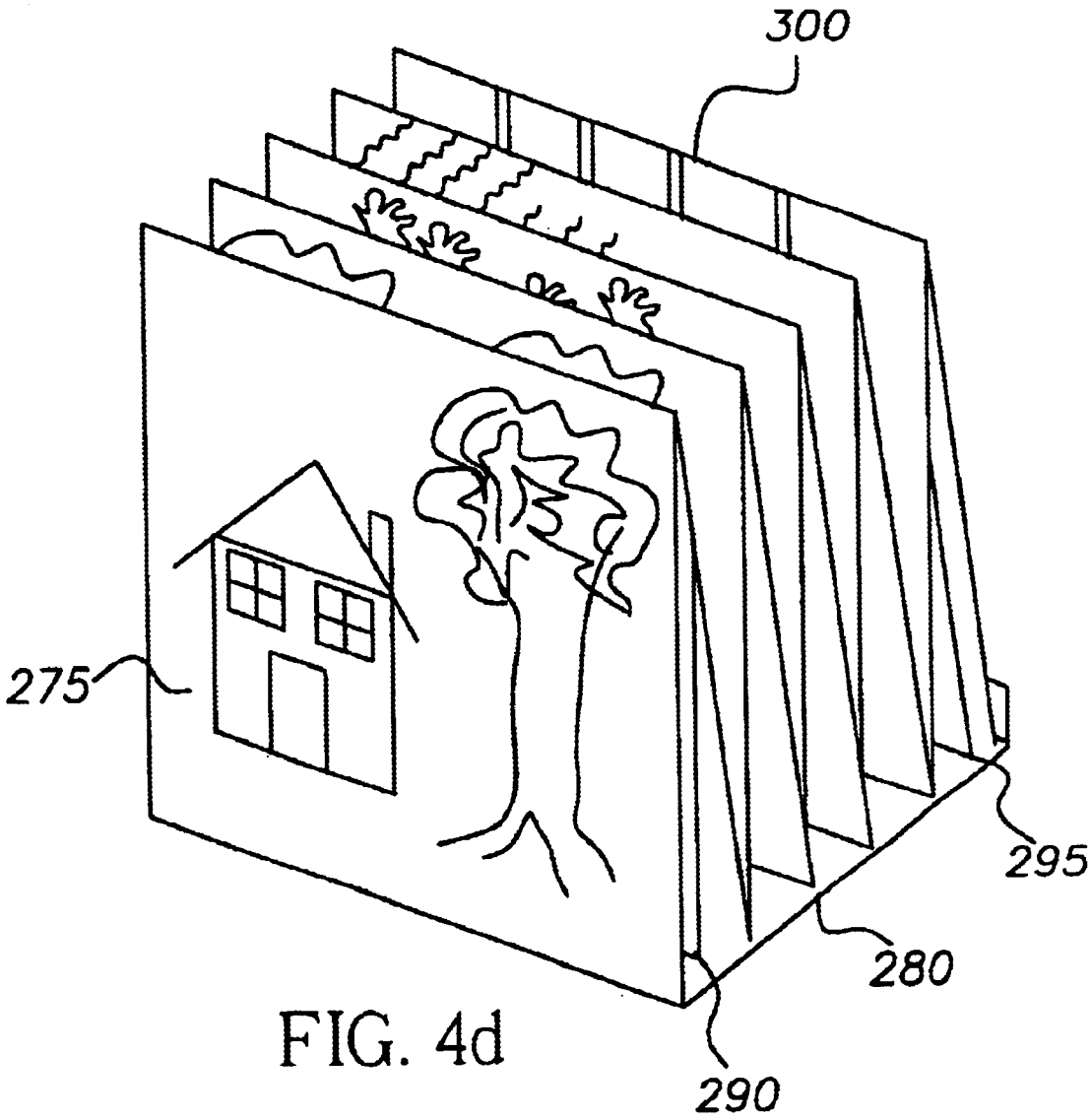
FIG. 4*d* is a perspective and exploded view of the photo album of FIGS. 4*a*–4*c;*

FIGS. 4*a*–4*d* illustrate another embodiment of the invention employing alternative means for reinforcing covers and for providing a binding for the finished photo album. FIG. 4*a* shows a strip of image bearing media 270 with images printed thereon exactly as has been previously illustrated in FIGS. 1, 2 and 3. The strip 270 also includes a front cover image 275 and a rear cover image (not shown). Directly adjacent the cover image 275 is an end flap 280 which is used to form an integral binding for the photo album. FIG. 4*b* shows an end view of the strip 270 with front cover image 275 and rear cover image 285 and with accordion folds 286 introduced between the images, as has been illustrated previously for the examples of FIGS. 1, 2 and 3. Reinforcing sheets 290 and 295 have been inserted between the first and last folds of strip 270 to stiffen the photo album covers. FIG. 4*c* shows a slightly exploded end view of the completed photo album 300 where a binding has been formed by wrapping the end flap 280 around and adhering it to the base of the photo album 300. FIG. 4*d* shows an exploded perspective view of the completed album 300 with front cover image 275 visible and further illustrating the position of reinforcing sheets 290 and 295 and binding end flap 280.

Figure 5:
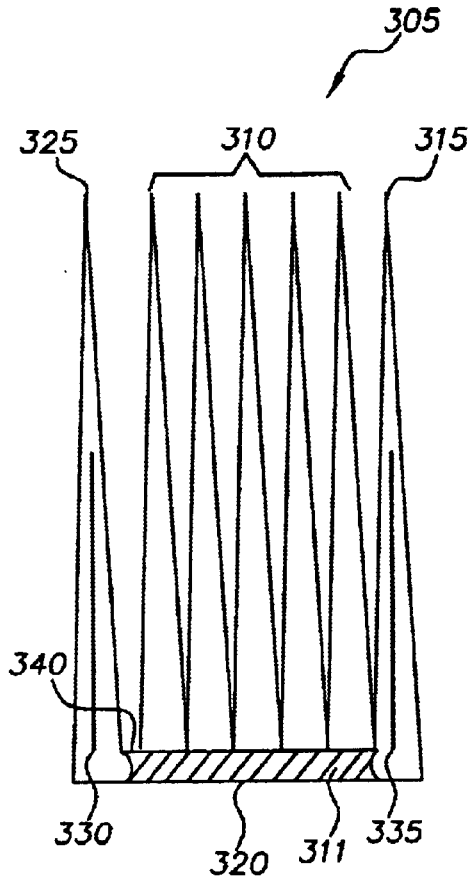
FIG. 5 is an end view of another photo album embodiment of the present invention.

In FIG. 5 is depicted an end view of another embodiment of the invention where no seams, binding clips, or overlapping areas are visible in the completed photo album. The photo album 305 of FIG. 5 is formed exactly as has been illustrated for the previous examples of FIGS. 1–4, beginning with a continuous strip of imaging media with images printed thereon and first introducing accordion folds to form the pages 310 of the album. After folding to form the rear cover 315 of the album the media strip is wrapped around the base of pages 310 and adhered to them by means of an adhesive 311 to form a binding 320 and finally is folded over and tucked back in the album to form the front cover 325. Reinforcing sheets 330 and 335 are inserted into the front and rear covers 325 and 315 respectively to provide stiffening. The only seam 340 in the album is hidden from view between the front cover 325 and the photo album pages 310.

Figure 6:
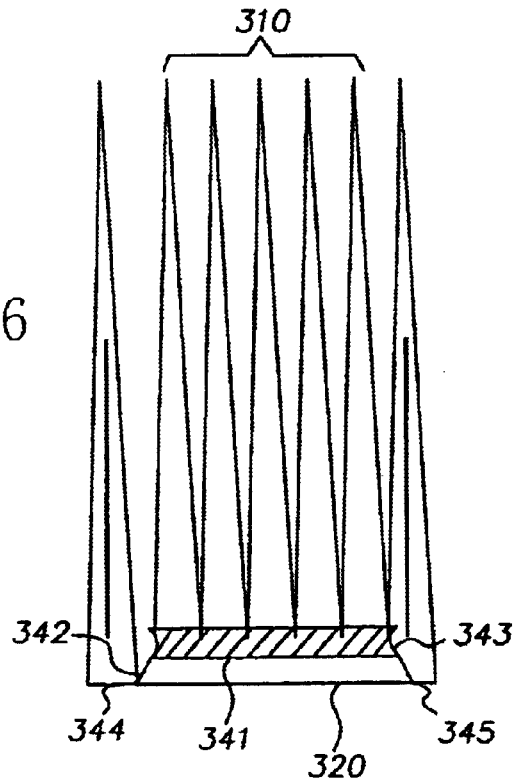
FIG. 6 is an end view of a variation in the embodiment of FIG. 5.

FIG. 6 shows an end view of a further variation on the seamless photo album embodiment of FIG. 5 with an alternative binding arrangement (like numbers in FIGS. 5 and 6 refer to like parts with like functions). The photo album of FIG. 6 is identical to the photo album of FIG. 5, except that adhesive 311 is absent and end flap 341 of the strip of imaging media is crimped at position 342 and extended across the ends of pages 310 and adhered to the pages by means of adhesive 343. End flap 341 is also adhered to binding 320 at points of attachment 344 and 345. The binding arrangement shown in FIG. 6 is similar to that employed in a hardbound book and allows for more flexibility in the binding when opening the photo album to view it.

In order to more fully explain the present invention, the sequence of steps which must be carried out to specify and complete a photo album will now be described.

Figure 7:
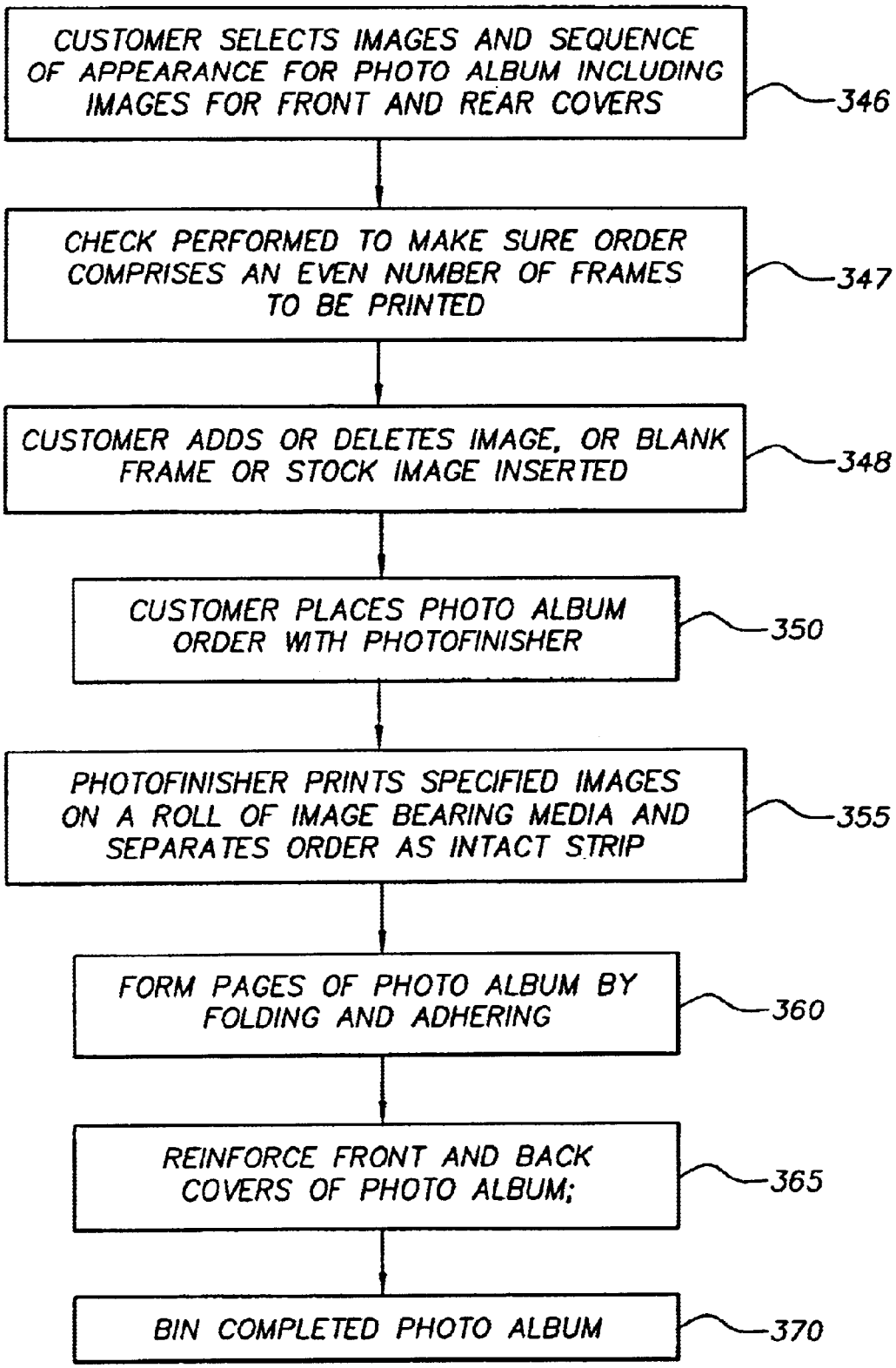
FIG. 7 shows the steps to be carried out in the practice of the present invention.

Referring to FIG. 7, a customer first specifies the images to be included in the photo album 346, including the order in which the images are to appear in the completed album. Step 346 also includes a specification of which images are to appear on the front and rear covers of the photo album and may include the addition of text in the form of an album title. Descriptive text or captions to be added to other images in the photo album may also be specified at this step. A selection of pre-stored images may also be provided to the customer to serve, for example, as images or backgrounds for the front or rear covers of the photo album. Step 346 may be performed by a customer filling out a paper order form or using an interactive kiosk with electronic display and suitable input device or using software running on a home computer followed by submitting the order electronically over a communication channel.

Since the covers and pages of the photo album each require two images, corresponding to the front and back of each page or cover, then the order specification must comprise an even number of images. A count of the number of images specified is performed at this time 347. The count of images must also account for any panoramic images specified; since panoramic are printed at twice the width of a standard image and occupies the space in the album of two adjacent images, each panoramic image specified must be counted as two images. Moreover, for a panoramic image to be properly viewable in the completed photo album, the panoramic image must be placed in the sequence of images so that it begins on an even numbered page of the album and a check must be performed also at this time to make sure the position of any panoramic image has properly positioned in the sequence. Should the count of step 347 indicate an odd number of frames has been specified, the customer is prompted to either eliminate one image or add another image to the images specified 348. As an alternative to adding or deleting an image, the customer may be also offered either the option to leave a blank page (for example, as the back cover of the album) or to select a stock image provided by the photofinisher for inclusion in the album.

Next, an order for the specified photo album is placed with a photofinisher 350 either by submitting or mailing the completed paper order form or electronically submitting the order from an interactive kiosk or from a home computer over the internet. Once received, the photofinisher prints the order 355 in the specified order of images using standard optical or digital roll printing photofinishing equipment. In the case of certain of the embodiments described previously, it may be necessary for the printer to advance between prints to create blank spaces to be used for a binding gutter margin or at the beginning or end of an order to create blank tabs for reinforcing the photo album covers or to create a flap to bind the album. Once completed, the strip of images corresponding to the photo album order, including any beginning and ending tabs, is separated intact from the other orders on the roll. Pages of the photo album are now formed by folding and adhering the folds together 360, as described in detail above. After the pages are formed, the front and rear covers of the photo album are reinforced 365, the album is bound 370 and returned to the customer.

The invention has been described in detail with particular reference to certain preferred embodiments thereof, but it will be understood that variations and modifications can be effected within the scope of the invention.

Parts List

10 image bearing media
15 image
20 image
25 image
30 image
35 image
40 image
49 fold position
50 fold position
51 fold position
55 fold position
56 fold position
60 fold position
61 fold position
65 page
70 page
75 page
76 binding clip
80 image bearing media
85 image
90 image

95 image
100 image
105 image
110 image
115 fold position
120 fold position
125 fold position
130 gutter margin
131 center point
132 fold line position
133 fold line position
135 gutter margin
136 center point
137 fold line position
138 fold line position
140 gutter margin
141 center point
142 fold line position
143 fold line position
145 gutter margin
146 center point
147 fold line position
148 fold line position
150 page
155 page
160 page
165 gutter margin area
166 binding clip
170 image bearing media
180 image
185 image
190 image
195 image
200 image
205 cover image
210 reinforcement end section
215 fold position
220 fold position
225 fold position
230 fold position
235 fold position
240 fold position
245 fold position
250 front cover
255 rear cover
260 photo album
265 binding clip
270 image bearing media
275 cover image
280 end flap
285 cover image
286 accordion folds
290 reinforcing sheet
295 reinforcing sheet
300 photo album
305 photo album
310 pages
311 adhesive
315 rear cover
320 binding
325 front cover
330 reinforcing sheet
335 reinforcing sheet
340 seam
341 end flap
342 crimp position
343 adhesive
344 point of attachment
345 point of attachment
346 image specifying step
347 image counting step
350 order placement step
355 printing step
360 page formation step
365 cover reinforcement step
370 binding step

What is claimed is:

1. A photo album made from a unitary strip of image bearing media having a plurality of images printed in a pre-determined sequence thereon said plurality of images forming adjacent pairs of images, comprising:

a plurality of integral pages formed by folding said image media strip between said images into accordion folds so that each of said pair of adjacent images forms two sides of a page, said accordion folds being adhered together on the inside; and a binding holding said pages together, said binding comprising a flap formed integrally at the end of said media strip, said flap being folded around the base of said pages and adhered to said pages.

2. The photo album of claim 1 wherein a gutter margin for binding said pages has been created by introducing a non-image area between said adjacent pairs of images.

3. The photo album of claim 1 wherein at least one of said images is text.

4. The photo album of claim 1 wherein at least one of said images has a caption added.

5. The photo album of claim 1 wherein at least one of said plurality of images has been composited with a graphic.

6. The photo album of claim 1 wherein at least one pair of said plurality of images are arranged to form a panoramic image.

7. The photo album of claim 1 wherein said binding comprises a binding clip.

8. The photo album of claim 1 further comprising reinforced front and rear album covers formed by folding end section of said image media strip inside first and last of said accordion folds respectively and adhering said end sections to said accordion folds.

9. The photo album of claim 1 further comprising reinforced front and rear album covers formed by inserting stiffening sheets into first and last said accordion folds and adhering said stiffening sheets inside said accordion folds.

10. A seamless photo album made from a unitary strip of image bearing media having a plurality of images printed in a pre-determined sequence thereon, said plurality of images forming ajacent pairs of images, comprising:

a plurality of integral pages formed by folding said image media strip between said images into accordion folds so that each pair of said adjacent pairs of images form two sides of a page, said accordion folds being adhered together on the inside;

a rear album cover formed from the last said accordion fold;

a binding for said photo album formed by wrapping said media strip around and adhering to the base of said plurality of pages; and a front album cover formed by folding an end of said image media strip over and tucking said end into said photo album and securing.

11. The seamless photo album of claim 10 wherein said front and rear album covers are reinforced with stiffening sheets.

12. A seamless photo album made from a unitary strip of image bearing media having a plurality of images printed in a pre-determined sequence thereon, said plurality of images forming adjacent pairs of images, comprising:

a plurality of integral pages formed by folding said image media strip between said pair of images into accordion folds so that each pair of said images forms two sides of a page, said accordion folds being adhered together on the inside; and a rear album cover formed from the last said accordion fold;

a front album cover formed by wrapping an end of said media strip around the base of said pages, folding said end of said image media strip over and inserting said end into said photo album; and a binding for said photo album formed by adhering said end of said media strip to the base of said plurality of pages.

13. A method of making a photo album, comprising the steps of:

obtaining a plurality of images;

specifying a desired order of appearance of said images in said photo album, the first said image being designated to appear on said photo album's front cover and the last said image being designated to appear on said photo album's rear cover;

printing said plurality of images in said specified order sequentially on the image bearing side of a roll of imaging media, said plurality of images forming adjacent pairs of sequential images;

separating said printed images from said roll in a continuous strip of media;

folding said media strip between said sequential images into accordion folds so that each of said pair of sequential images forms two sides of a page of said photo album, first and last said accordion folds forming said front and said rear covers of said photo album respectively;

adhering said pair of images forming each said page together on the inside of said accordion folds;

reinforcing said front and rear photo album with stiffening sheets; and binding said pages together.

14. The method of claim 13 further comprising the step of reinforcing said front and rear photo album covers with stiffening sheets.

15. The method of claim 13 further comprising the step of applying an adhesive to the non-image bearing side of said strip of image bearing media prior to the step of folding.

16. A photo album made from a unitary strip of image bearing media having a plurality of images printed in a pre-determined sequence thereon said plurality of images forming adjacent pairs of images, comprising:

a plurality of integral pages formed by folding said image media strip between said images into accordion folds so that each of said pair of adjacent images forms two sides of a page, said accordion folds being adhered together on the inside; and reinforced front and rear album covers formed by folding end sections of said image media strip inside first and last of said accordion folds respectively and adhering said end sections to said accordion folds.

17. A method of making a photo album, comprising the steps of:

obtaining a plurality of images;

specifying a desired order of appearance of said images in said photo album, the first said image being designated to appear on said photo album's front cover and the last said image being designated to appear on said photo album's rear cover;

printing said plurality of images in said specified order sequentially on the image bearing side of a roll of imaging media, said plurality of images forming adjacent pairs of sequential images;

separating said printed images from said roll in a continuous strip of media;

folding said media strip between said sequential images into accordion folds so that each of said pair of sequential images forms two sides of a page of said photo album, first and last said accordion folds forming said front and said rear covers of said photo album respectively;

adhering said pair of images forming each said page together on the inside of said accordion folds;

reinforcing said front and rear photoalbum with stiffening sheets;

securing said pages with a binding clip; and binding said pages together.

18. A method of making a photo album, comprising the steps of:

obtaining a plurality of images;

specifying a desired order of appearance of said images in said photo album, the first said image being designated to appear on said photo album's front cover and the last said image being designated to appear on said photo album's rear cover;

printing said plurality of images in said specified order sequentially on the image bearing side of a roll of imaging media, said plurality of images forming adjacent pairs of sequential images;

separating said printed images from said roll in a continuous strip of media;

folding said media strip between said sequential images into accordion folds so that each of said pair of sequential images forms two sides of a page of said photo album, first and last said accordion folds forming said front and said rear covers of said photo album respectively;

adhering said pair of images forming each said page together on the inside of said accordion folds;

reinforcing front and rear photo album with stiffening sheets;

folding a flap of media around the base of said pages and adhering said end to said pages, said flap being formed integrally at an end of said media strip; and binding said pages together.

* * * * *